US005957154A

United States Patent [19]

Olaker

[11] Patent Number: 5,957,154

[45] Date of Patent: Sep. 28, 1999

[54] FIRE HYDRANT ADAPTOR AND COVER

[76] Inventor: Anderson E. Olaker, 8036 S. Blackstone, Chicago, Ill. 60619

[21] Appl. No.: 09/080,048

[22] Filed: May 15, 1998

[51] Int. Cl.[6] ..... F16K 35/10; E03B 9/06

[52] U.S. Cl. ..... 137/296; 137/800; 220/284; 220/288

[58] Field of Search ..... 137/292, 294, 137/295, 296, 377, 381, 382, 800; 220/284, 288, 726, 724, 727, 730

[56] References Cited

U.S. PATENT DOCUMENTS

| | | | |
|---|---|---|---|
| 402,115 | 4/1889 | Tyler | 137/294 |
| 1,163,820 | 12/1915 | Hayes | 220/288 |
| 1,346,496 | 7/1920 | Housley | 220/284 |
| 2,576,631 | 11/1951 | Mueller | 137/296 |
| 3,070,115 | 12/1962 | Jester | 137/296 |
| 3,405,837 | 10/1968 | Carpenter | 137/296 |
| 3,534,941 | 10/1970 | Dunton | 137/296 |
| 4,141,574 | 2/1979 | Stansifer et al. | 137/296 |
| 4,182,361 | 1/1980 | Oakey | 137/296 |
| 4,602,654 | 7/1986 | Stehling et al. | 137/296 |
| 4,651,771 | 3/1987 | Borenstein et al. | 137/296 |
| 4,770,203 | 9/1988 | Laurel | 137/296 |
| 4,825,898 | 5/1989 | Vis | 137/296 |
| 4,957,266 | 9/1990 | Ellis | 220/288 |
| 5,072,750 | 12/1991 | Poms et al. | 137/377 |

*Primary Examiner*—George L. Walton
*Attorney, Agent, or Firm*—Gilhooly and Crossman

[57] ABSTRACT

A fire hydrant adaptor and cover for attachment to the uncovered outlet pipe of a fire hydrant. The fire hydrant adaptor and cover includes an adaptor pipe having a first end with internal threads of attachment to the fire hydrant outlet, and a second end having external threads to connect a fire hose and internal threads to secure a cover plate. The cover plate is formed from a metallic material and is inserted into the second end of the adaptor pipe. The cover plate is removed by magnetized elements or by engaging a rectangular hole formed on the cover face.

8 Claims, 1 Drawing Sheet

FIG. 1
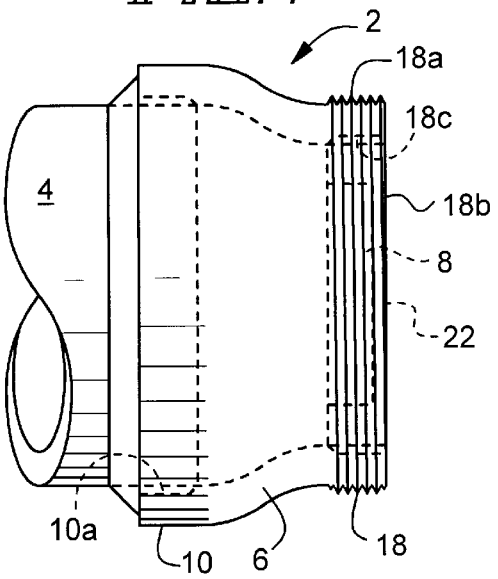
FIG. 2
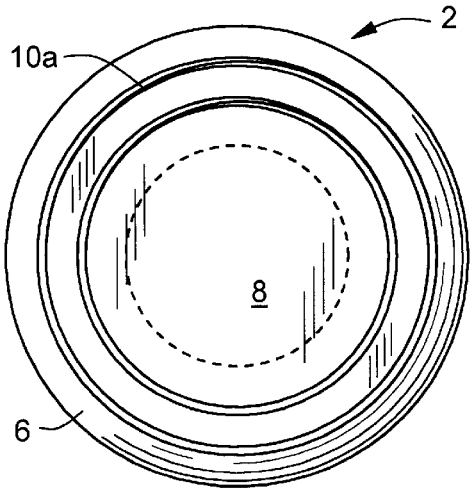
FIG. 5
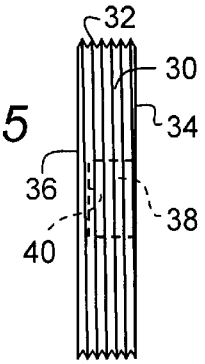
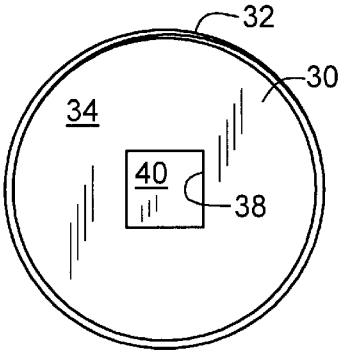
FIG. 6
FIG. 3
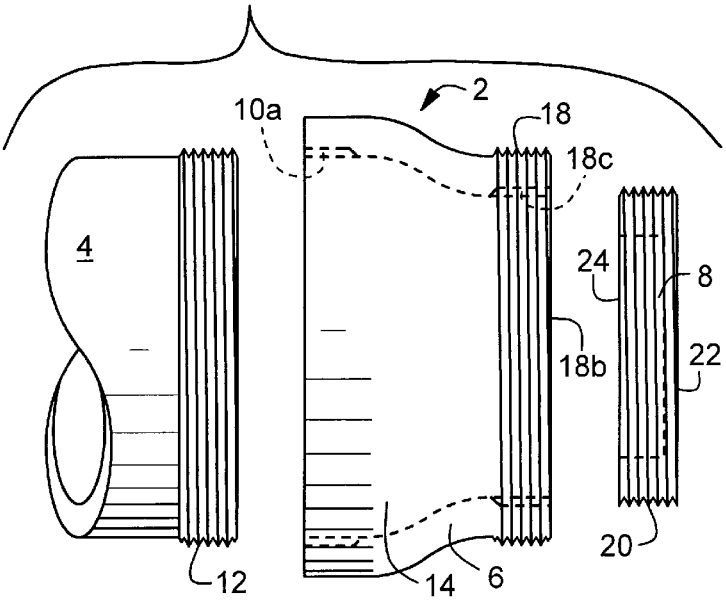
FIG. 4
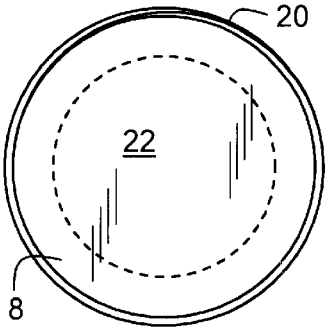

FIRE HYDRANT ADAPTOR AND COVER

BACKGROUND OF THE INVENTION

1. Field of the Invention

This invention relates in general to fire hydrants and, more specifically, to a tamper proof adaptor and cover for a fire hydrant.

2. Summary of the Prior Art

In many communities, the unauthorized use of a fire hydrant creates several adverse conditions. Even the innocent opening of a fire hydrant by an individual in non-emergency situations, such as during hot summer days, can dangerously lower the water pressure at the hydrant. Such a lowering of water pressure can interfere with the effectiveness of the fire department when confronted with a fire in an emergency situation. Open fire hydrants also unduly waste water resources and can create hazardous slippery conditions in the vicinity of the fire hydrant, particularly during winter months. The basic fire hydrant design provides inadequate protection against tampering with the result that fire hydrants are easily opened in non-emergency situations on a too frequent basis. Accordingly, it is desirable to provide an inexpensive technique by which a fire hydrant is protected against tampering.

SUMMARY OF THE INVENTION

It is, therefore, an objective of this invention to provide a fire hydrant adaptor and cover capable of inexpensively and effectively protecting a conventional fire hydrant against unauthorized use. The fire hydrant adaptor and cover of the invention may be readily attached to any existing fire hydrant or be incorporated in a fire hydrant being manufactured in a manner to minimize cost of installation. When installed the invention includes means that cannot be readily removed by conventional tools and requires removal by authorized personnel, such as a fireman and the like. The cover of the invention in the one embodiment is removable by a magnetic means or alternatively in a second embodiment by a large tool, such as an impact wrench.

BRIEF DESCRIPTION OF THE DRAWINGS

FIG. 1 is a side elevational view of the first embodiment of the fire hydrant adaptor and cover of the invention;

FIG. 2 is an end elevational view of the fire hydrant adaptor and cover of FIG. 1;

FIG. 3 is a side elevational view, with parts exploded, of the fire hydrant adaptor and cover of FIG. 1;

FIG. 4 is an end elevational view of the cover of the first embodiment of the fire hydrant adaptor and cover of FIG. 1;

FIG. 5 is a side elevational view of a second embodiment of a cover for the fire hydrant adaptor and cover of the invention; and FIG. 6 is an end elevational view of the second embodiment of the cover of FIG. 5.

DESCRIPTION OF THE PREFERRED EMBODIMENTS

Referring now to FIGS. 1–4, there is illustrated a first embodiment of the fire hydrant adaptor and cover, generally designated by reference numeral 2. The fire hydrant adaptor and cover 2 is adapted to be attached to the circular outlet pipe 4, having its cover removed, (not shown), of a conventional fire hydrant (not shown). As is well known, the outlet pipe 4 is intended to be connected to a fire hose for delivery of water after the cover has been removed. The relative easy removal of the outlet pipe cover allows for unauthorized use of the fire hydrant to produce adverse conditions. The fire hydrant adaptor and cover 2 includes an adaptor pipe 6 and an internally mounted cover plate 8, both made of metal. The adaptor pipe 6 has an enlarged end 10 provided with internal threads 10*a* to engage the conventional threaded end (FIG. 3) of the outlet pipe 4 of the fire hydrant. The adaptor pipe includes an internal passageway 14 through which water from the outlet pipe 4 can be directed externally in the absence of the cover plate 8. When attached to the threads 12, the enlarged end 10 may be welded or otherwise permanently affixed to the outlet pipe 4 to prevent unauthorized removal.

The outer end of the adaptor pipe 6 has a reduced diameter 18 having external threads 18*a*formed thereon for attachment of a fire hose. As should be apparent, the threads 18*a* and diameter of end 18 correspond to the threads 12 and diameter of the outlet pipe 4. The end 18 of the adaptor pipe 6 forms a water outlet 18*b* to deliver water to a fire hose (not shown). When the fire hydrant is not being used by authorized personnel, the cover plate 8 is mounted wholly or substantially wholly within the end 18 of the hydrant adaptor pipe 6. Such a mounting renders cover plate 8 difficult to remove without specific tools. As best seen in FIGS. 4 and 5, the cover plate 8 has circular cross-section formed with external threads 20 which engage the internal threads 18*c* formed around outlet 18*b*. As shown in FIGS. 4 and 5, the cover plate 8 has a solid outer face 22 and a solid inner face 24 to block the flow of water from the hydrant. When mounted, the cover plate 8 is positioned substantially within the end 18 of the adaptor pipe 6. The cover plate 8 can be removed by authorized personnel through the use of magnetized means (not shown), such as a rotary type device having external magnets to create an attractive connection between the tool and the cover plate 8 to allow rotation and removal.

Referring now to FIGS. 5 and 6, there is illustrated a second embodiment of the cover plate of the invention, generally designated by reference numeral 30. Cover plate 30 is intended to be used with adaptor 6 in a similar manner as cover 8, except that the technique of removal is modified. The cover 32 is also formed from a metallic material having a circular configuration with external threads 32 being formed on its periphery. A front face 34 and a rear face 36 are provided on cover plate 30. A rectangular hole 38 extends through front face 34 and includes a closed rear end 40. The cover plate 30 is positioned within end 18 of adaptor pipe 6 in the same manner as FIG. 1, but may be removed by a tool being inserted in the hole 38. Such a tool can be an impact wrench and the like used by authorized personnel, such that the end of the impact wrench is inserted within the hole 38 and the cover 30 rotated from position for emergency situations. The hole 38 may be a plurality of holes or encompass other shapes, such as rectangular, triangular or multi-sides shapes, as is suitable for removal of the cover plate 30.

In the foregoing description of embodiments of FIGS. 1–6, it is shown that the cover plate 8 or cover plate 30 is positioned so that the covers are not readily removed by unauthorized personnel and require more sophisticated removal techniques than normally available to the average citizen. The adaptor and covers herein disclosed can be directly incorporated as the outlet pipe of a fire hydrant during manufacture to provide the capability right from the factory for preventing unauthorized use of the hydrant in accordance with the teachings of the invention.

What is claimed:

1. A fire hydrant pipe and cover for attachment to an outlet of a fire hydrant comprising a pipe being positioned external of the fire hydrant having a first end being attachable to the outlet of the fire hydrant, said pipe having a passage between said first end to a second end of said pipe, a water outlet formed on said second end, said second end of said pipe having external threads adapted for receiving a fire hose, said second end further forming internal threads substantially around said outlet, and a cover plate having flat exterior face being arranged to be wholly positioned within said second end for closing said outlet, said flat exterior face forming a generally smooth end surface aligned and flush with said second end to prevent authorized use.

2. The fire hydrant pipe and cover according to claim 1 wherein said cover plate is formed from a metal material capable of being attracted to a magnetic material for removal of said cover plate from said second end.

3. The fire hydrant pipe and cover according to claim 2 wherein said cover plate has a circular cross-sectional configuration.

4. The fire hydrant pipe and cover according to claim 1 further including hole means formed in said cover plate through said flat exterior face.

5. The fire hydrant pipe and cover according to claim 4 wherein said hole means includes a shape capable of engaging an external tool for removal of said cover plate from said second end.

6. The fire hydrant pipe and cover according to claim 5 wherein said hole means has a square configuration.

7. The fire hydrant pipe and cover according to claim 1 wherein said pipe is an adaptor pipe adapted to be attached to the outlet pipe of a fire hydrant.

8. The fire hydrant pipe and cover according to claim 1 wherein said cover plate is circular plate having threads around its periphery.

* * * * *